US008827773B2

(12) United States Patent
Sjolander et al.

(10) Patent No.: US 8,827,773 B2
(45) Date of Patent: Sep. 9, 2014

(54) MANUAL LOCKING MEANS FOR BIT HOLDER WITH MICRO/MACRO ADJUSTMENT

(75) Inventors: Bjorn Sjolander, Burlington (CA); Bo Thomas Sjolander, Oakville (CA); Robert Sjolander, Oakville (CA)

(73) Assignee: C.M.E. Blasting & Mining Equipment Ltd., Oakville (Ontario) (CA)

( * ) Notice: Subject to any disclaimer, the term of this patent is extended or adjusted under 35 U.S.C. 154(b) by 727 days.

(21) Appl. No.: 13/003,054

(22) PCT Filed: Jul. 8, 2009

(86) PCT No.: PCT/CA2009/000932

§ 371 (c)(1),
(2), (4) Date: Jan. 7, 2011

(87) PCT Pub. No.: WO2010/003229

PCT Pub. Date: Jan. 14, 2010

(65) Prior Publication Data

US 2011/0117826 A1 May 19, 2011

(30) Foreign Application Priority Data

Jul. 8, 2008 (CA) ..... 2636995

(51) Int. Cl.
*B23B 41/06* (2006.01)

(52) U.S. Cl.
USPC ..... 451/365; 451/375; 269/165; 269/170; 269/217

(58) Field of Classification Search
USPC ..... 451/48, 231, 178, 365, 375; 269/162, 269/165, 170, 201, 217, 228
See application file for complete search history.

(56) References Cited

U.S. PATENT DOCUMENTS

| | | | | | |
|---|---|---|---|---|---|
| 864,166 | A * | 8/1907 | Herrick | 269/162 |
| 3,815,894 | A * | 6/1974 | Olson | 269/167 |
| 3,888,049 | A * | 6/1975 | MacSween | 451/158 |
| 4,821,463 | A * | 4/1989 | Fuller, Jr. | 451/335 |
| 4,837,983 | A * | 6/1989 | Fuller, Jr. | 451/8 |
| 4,848,036 | A * | 7/1989 | Kiso | 451/226 |
| 4,974,372 | A * | 12/1990 | Chantalat | 451/48 |
| 5,070,654 | A * | 12/1991 | Manqvist et al. | 451/271 |
| 5,138,797 | A * | 8/1992 | Siden | 451/241 |
| 5,327,685 | A * | 7/1994 | Chang | 451/415 |
| 5,649,853 | A * | 7/1997 | Kuo | 451/178 |
| 6,110,018 | A * | 8/2000 | Hepworth | 451/48 |
| 6,280,307 | B1 * | 8/2001 | Lea | 451/344 |
| 6,652,367 | B1 * | 11/2003 | Lin | 451/178 |
| 6,878,035 | B2 * | 4/2005 | Varney et al. | 451/5 |
| 2003/0220057 | A1 * | 11/2003 | Lin | 451/210 |
| 2004/0106356 | A1 * | 6/2004 | Varney et al. | 451/5 |
| 2007/0004320 | A1 * | 1/2007 | Lindgren | 451/11 |

FOREIGN PATENT DOCUMENTS

| | | | |
|---|---|---|---|
| CA | 609113 | A | 11/1960 |
| CA | 2335512 | A1 | 1/2000 |

* cited by examiner

*Primary Examiner* — Eileen P. Morgan
(74) *Attorney, Agent, or Firm* — Volpe and Koenig, P.C.

(57) ABSTRACT

A locking means for a bit holder fixture for use with grinding apparatus for grinding the hard metal inserts of rock drill bits is provided. The locking means has a macro adjustment for quick positioning of a pressure plate against the body of the bit(s) and a micro adjustment to lock the bit(s) in place by applying pressure against the skirt or shank of the drill bit(s).

31 Claims, 11 Drawing Sheets

MANUAL LOCKING MEANS FOR BIT HOLDER WITH MICRO/MACRO ADJUSTMENT

BACKGROUND OF THE INVENTION

The present invention relates to improvements in bit holders used with apparatus for grinding the hard metal inserts or working tips of drill bits (percussive or rotary), tunnel boring machine cutters (TSM) and raised bore machine cutters (REM) and more specifically, a safe, simple, compact, yet effective locking means for a wide range and number of bit sizes and types within a bit holder fixture holding one or more bits.

In drilling operations the cutting teeth (buttons) on the drill bits or cutters become flattened (worn) after continued use. Regular maintenance of the drill bit or cutter by regrinding (sharpening) the buttons to restore them to substantially their original profile enhances the bit/cutter life, speeds up drilling and reduces drilling costs. Regrinding should be undertaken when the wear of the buttons is optimally one third to a maximum of one-half the button diameter.

Manufacturers have developed a range of different grinding apparatus including hand held grinders, single arm and double arm self centering machines for setting up two or more bits to be ground, mobile machines for grinding on the road or in a workshop and grinders designed specifically for mounting on drill rigs, service vehicles or set up in the shop.

Conventional locking means for a wide range and number of bit sizes and types within a bit holder used with existing machines are either too slow and prone to wear or too complicated for simple installations. The conventional manual locking means used with current bit holders utilizes a rotating screw type locking means with a lever or knob to lock the drill bits in place are cumbersome and do not allow for fast movement between maximum and minimum settings as the screw or threaded rod has to be rotated until the desired location is reached. The other conventional locking means consists of a cylinder that has a piston rod that retracts and extends by operating a manual valve. This type of locking means requires supply lines between a compressed air or hydraulic source to operate. Cylinders in conventional locking means are sized so that they consist of a piston rod that has a long enough stroke to achieve desired range of movement between maximum and minimum settings. This can both complicate installation as well as limit the configuration of the locking means configuration. For example, it would be rather difficult and space intensive to install multiple locking means using multiple cylinders in a rotating application.

The present invention provides a manual locking means for a bit holder fixture with two adjustments. A macro adjustment allows for quick positioning of a pressure plate against the body of the bit(s). A micro adjustment locks the bit(s) in place by applying pressure against the skirt or shank of the drill bit(s). By keeping the locking means safe, simple, effective and compact, it allows multiple locking means to be installed with ease within a bit holder fixture, as deemed necessary. Improved operator safety is achieved by separating macro and micro adjustment so that micro adjustment is used to apply the necessary pressure to lock bit(s) in place.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying photographs, in which.

DETAILED DESCRIPTION OF PREFERRED EMBODIMENTS

Figure 1:
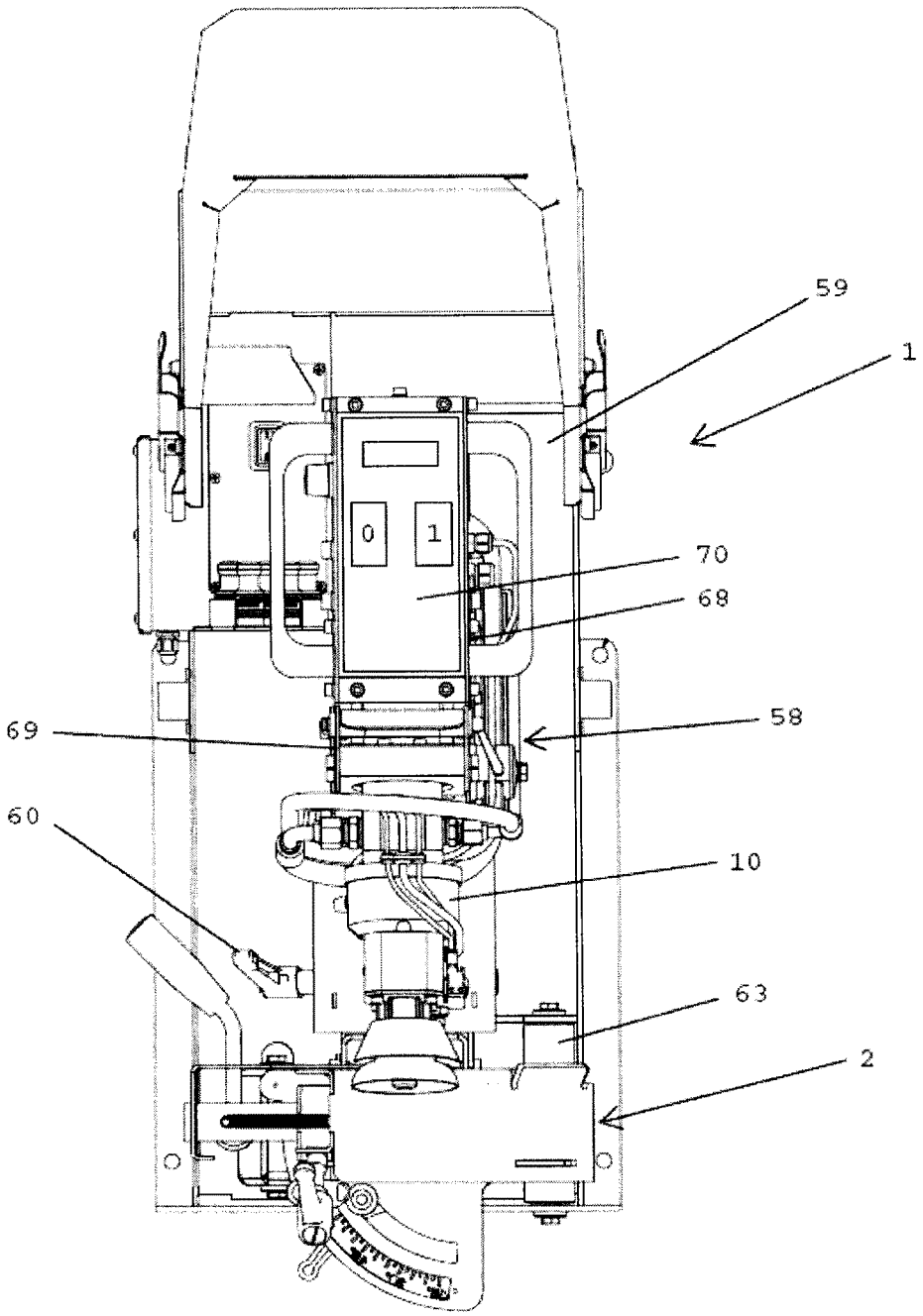
FIG. 1 is a perspective schematic view from the front right side of a grinding apparatus having a grinding machine and a bit holder fixture with one embodiment of manual locking means according to the present invention with a macro adjustment means and a micro adjustment means.

While the present invention is applicable to all grinding apparatus having a grinding machine carried for vertical and horizontal adjustment by an arm or lever system journaled on a stand or frame and preferably with a tiltable means for holding the bit to be ground, the grinding apparatus, generally indicated at 1, shown in FIG. 1 is of the type intended to be mounted on drill rigs, service vehicles or set up in the shop, optionally installed inside a cabinet enclosure.

Figure 2:
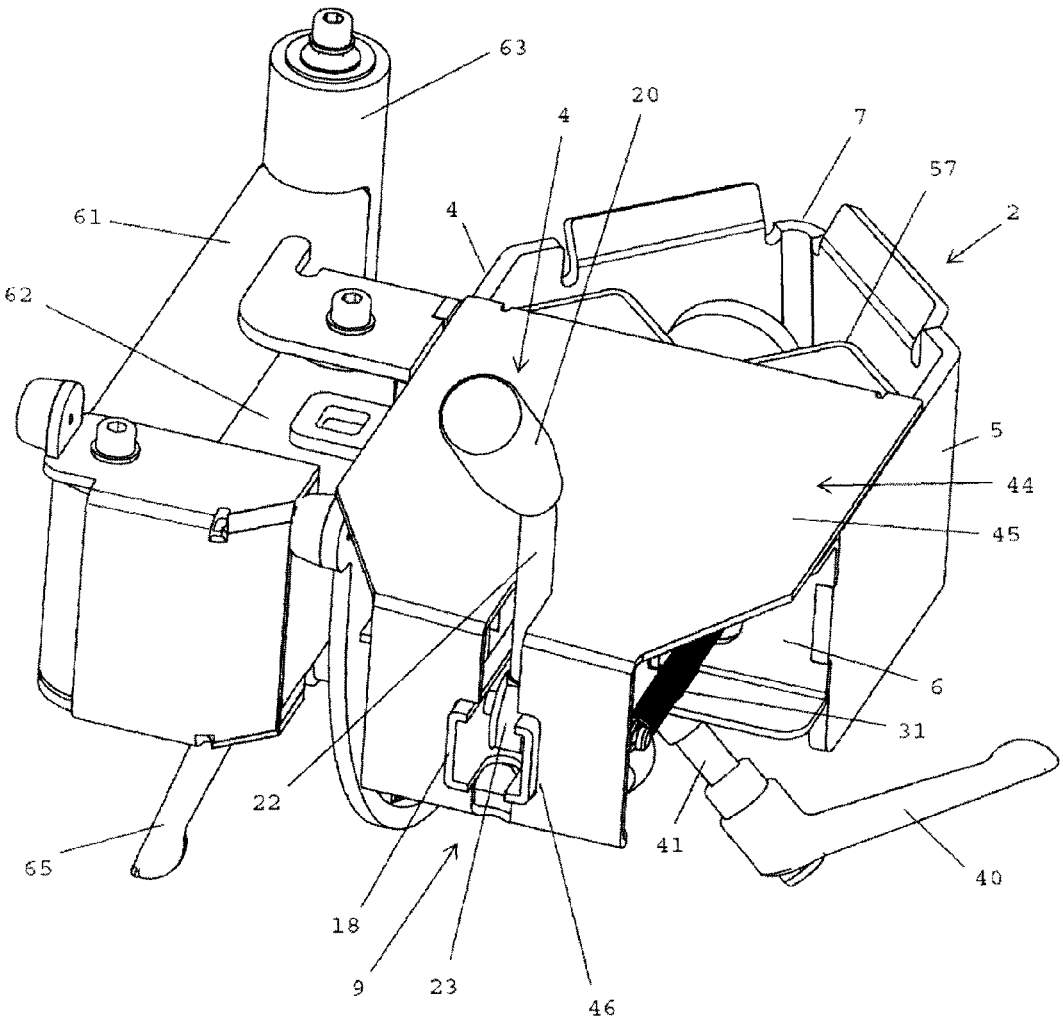
FIG. 2 is a perspective schematic view from the top front side of the bit holder fixture with manual locking means of FIG. 1.
Figure 3:
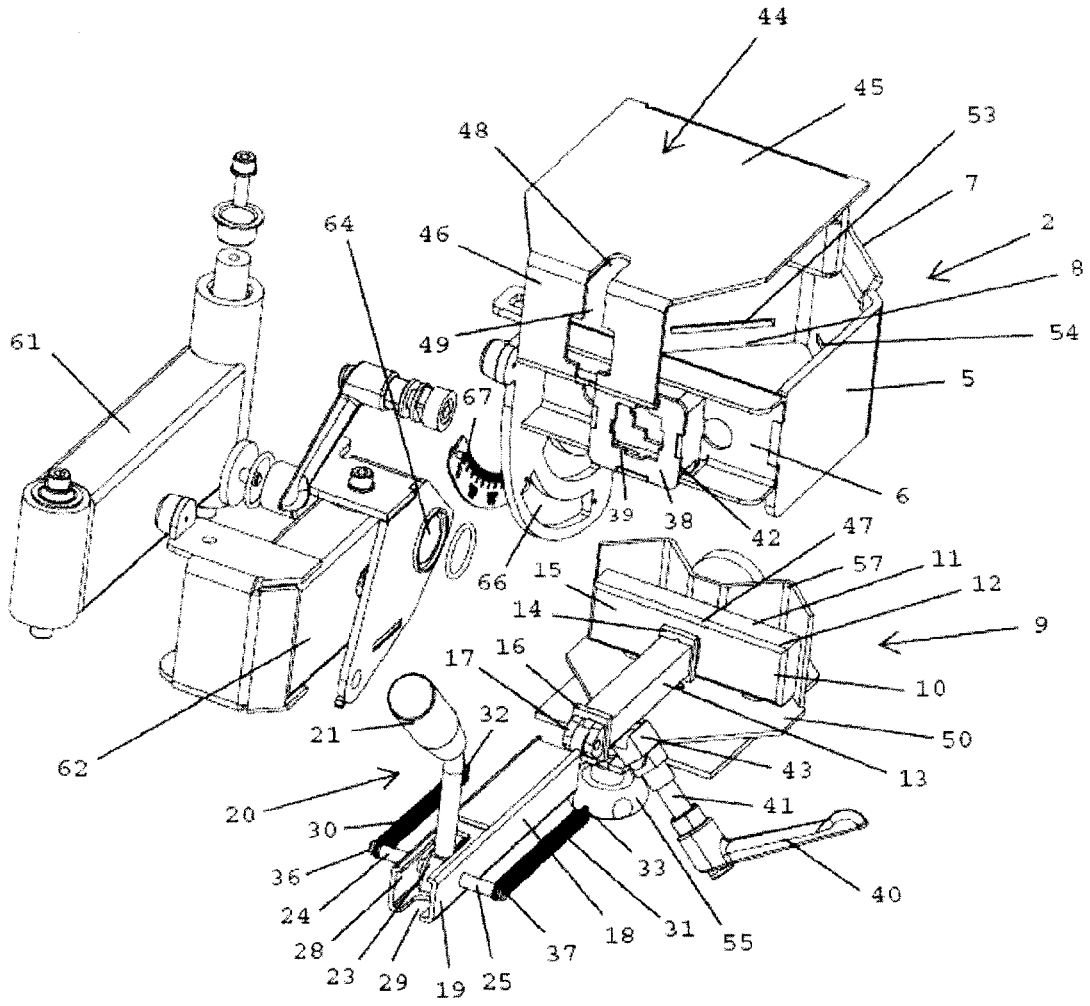
FIG. 3 is a parts diagram for the bit holder fixture with manual locking means of FIG. 2
Figure 4:
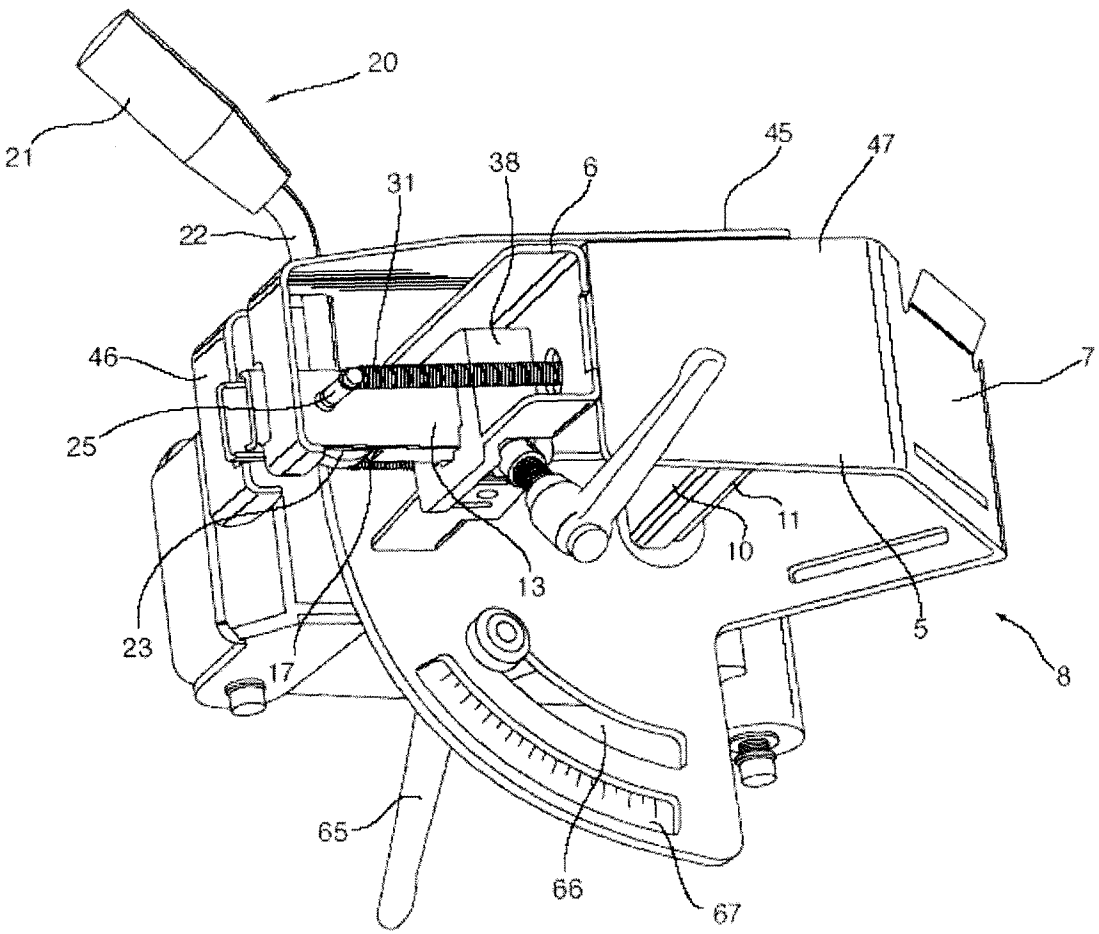
FIG. 4 is a perspective view from the bottom right side of the bit holder fixture with manual locking means of FIG. 2.
Figure 5:
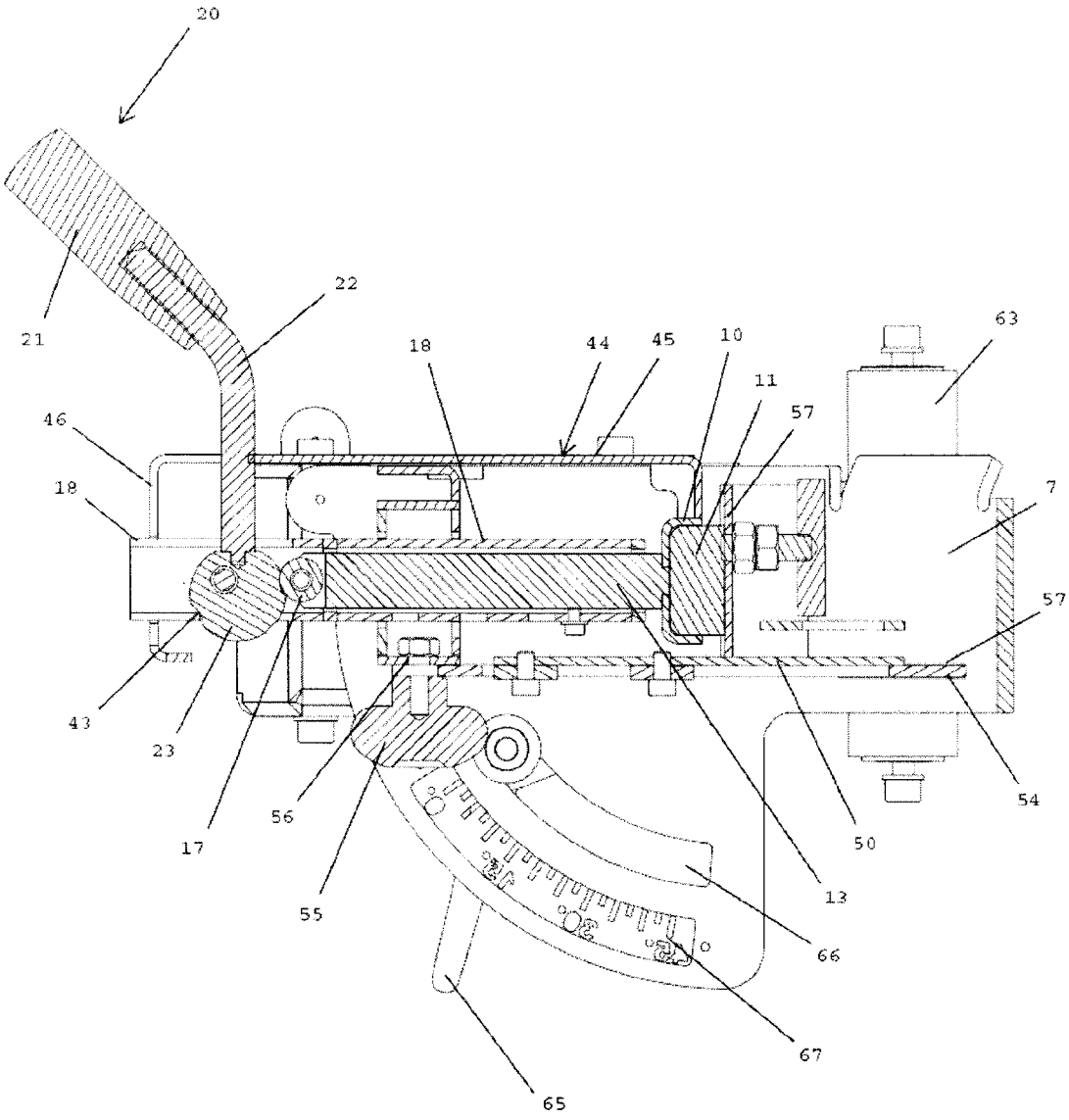
FIG. 5 is a side plan view in cross-section of the bit holder fixture with manual locking means of FIG. 2
Figure 6:
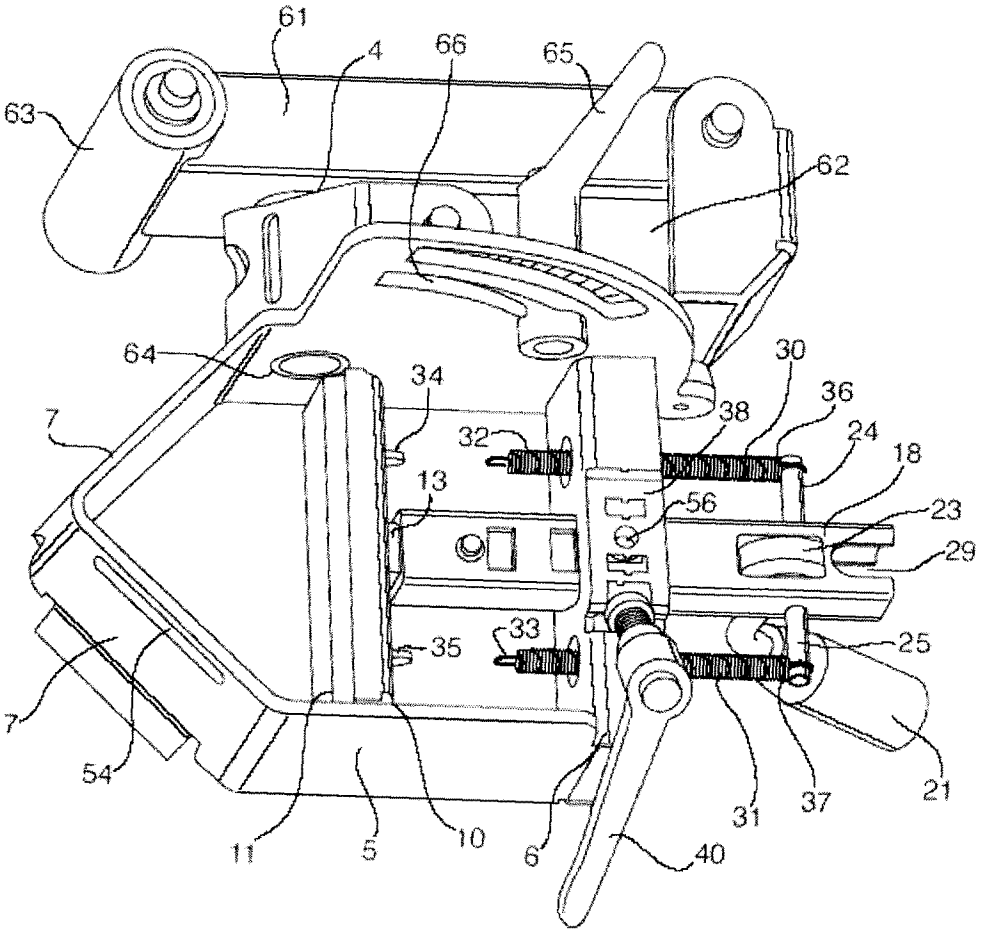
FIG. 6 is a bottom view of a stripped down version of the manual locking means of FIG. 2 showing the macro adjustment means.
Figure 7:
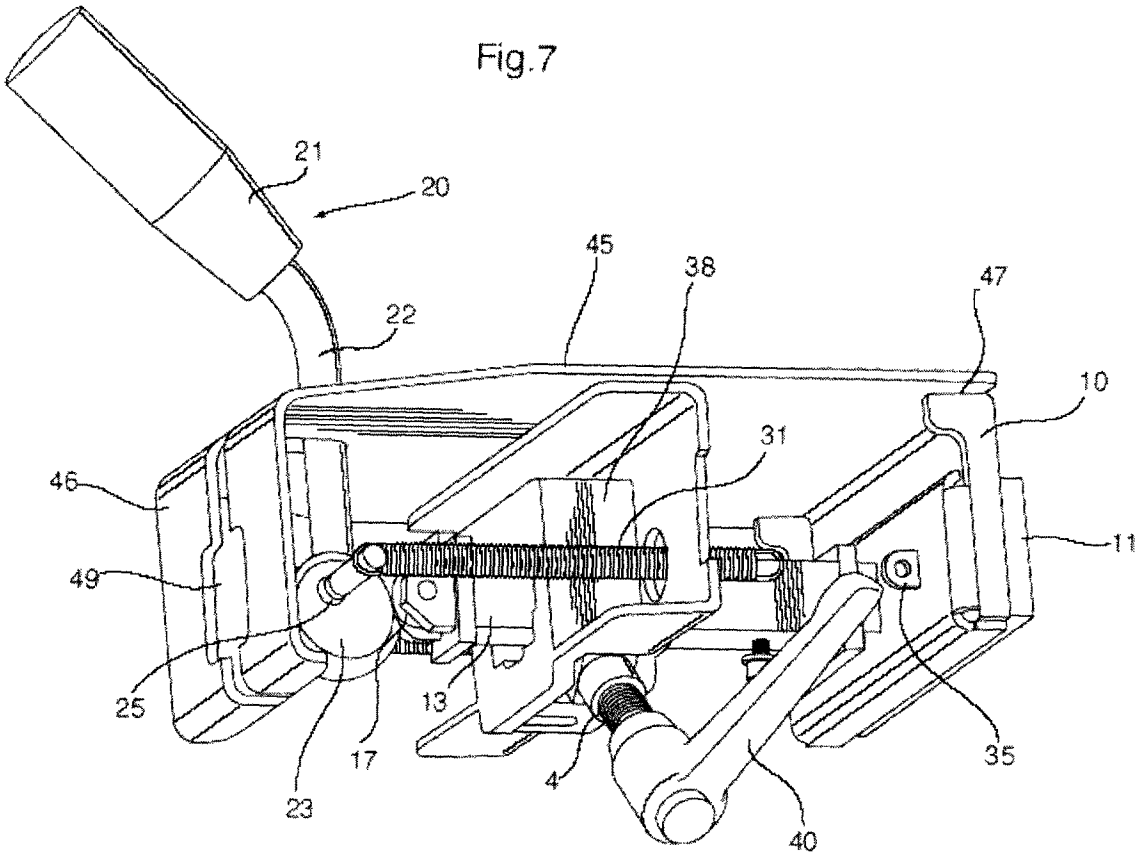
FIG. 7 is a right side view of the stripped down version of the manual locking means of FIG. 6.
Figure 8:
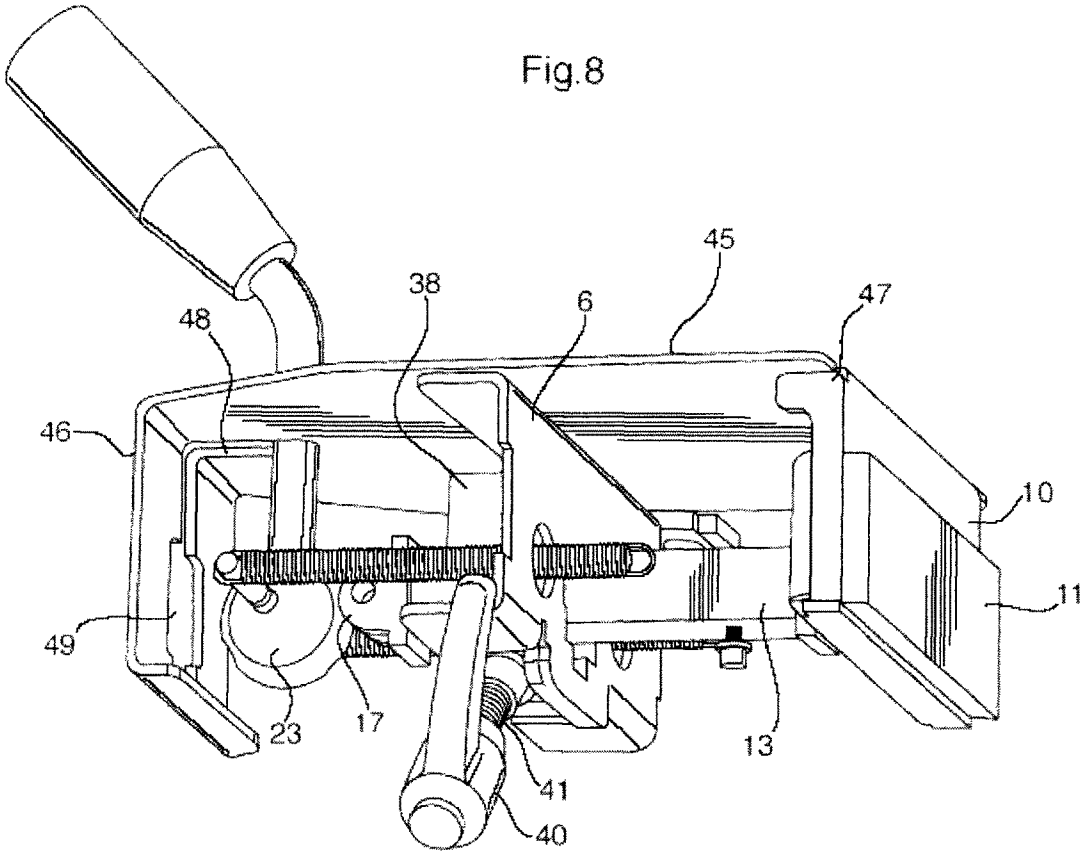
FIG. 8 is a bottom view of a stripped down version of the manual locking means of FIG. 2 showing the micro adjustment means.

The grinding apparatus 1 includes a grinding machine 10 and a bit holder fixture 2 for holding one or more bits to be ground. As best shown in FIGS. 2 & 3 the bit holder fixture 2, has opposite peripheral side walls 4,5, a front side 6 and a V-shaped rear side 7. The peripheral side walls 4,5, front side 6 and V-shaped rear side 7 define a pentagonal shaped aperture 8 into which one or more bits to be ground are placed. In the embodiment illustrated the front side 6 is adapted to support a manual locking means according to the present invention, generally indicated at 9, having a macro adjustment means and a micro adjustment means.

In the embodiment illustrated in FIGS. 1-8, the manual locking means 9 comprises an assembly including a pressure plate 10 having a generally rectangular configuration and with an pad 11 made preferably from an elastomeric material attached to a first face 12 of the pressure plate 10 intended to be facing bit(s) inserted into aperture 8 on bit holder fixture 2. This pad 11 helps hold the bit(s) securely as it conforms to the shape of the bit as pressure is applied. A first tube 13 has one end 14 attached perpendicular to a second face 15 of pressure plate 10. The other end 16 of the first tube 13 is adapted to retain a roller 17. The first tube 13 slides within a second tube 18 having an internal cross-section slightly larger than the external cross-section of the first tube 13 so that the first and second tubes 13,18 can slide relative to each other. The end 19 of the second tube 18 remote from pressure plate 10, is adapted to support a lever 20 having a handle 21 on one end of a shaft 22 and a cam 23 at the other end of shaft 22. A shaft 24 extends laterally through each side of cam 23 and through the second tube 18 to permit the lever 20 to rotate around the eccentric axis defined by shaft 24. Upper and lower slots 28,29 in the second tube 18 allow the lever 20 with cam 23 to rotate. A pair of return springs 30,31 have one end 32,33 connected to an anchor 34,35 on the second face 15 of pressure plate 10 and the other end 36,37 to the distal ends 26, 27 of shaft 24 extending through the second tube 18. The return springs 30,31 retain the cam 23 in contact with roller 17 on the end of the first tube 13.

The locking means 9 assembly as described above is supported within a block 38 mounted on the front side 6 of bit holder fixture 2. The second tube 18 slides within the opening 39 on block 38 with the pressure plate in aperture 8 on the bit holder fixture and lever 20 external to aperture 8. A locking lever 40 is connected to a threaded rod 41 which fits through a threaded hole 42 in block 38. On the other end of threaded rod 41 is a stopper 43. When locking lever 40 is turned it tightens stopper 43 locking the second tube 18 in position relative to the block 38. With locking lever 40 loosened the second tube 18 slides easily through block 38 permitting pressure plate 10 to be moved into contact with the body of a bit (not shown) within aperture 8. Locking lever 40 is then tightened to lock the second tube 18 in place. This acts as a macro adjustment of the locking means 9.

Once the macro adjustment is completed, the handle 21 of lever 20 can be moved, causing cam 23 to rotate around shaft 24. Rotating the cam 23, causes the first tube 13, to slide longitudinally within the second tube 18 pushing pressure plate 10 towards the skirt or shank of the bit(s) within the aperture 8. The cam 23 maintains the pressure applied until it is rotated so as to release the pressure. The cam 23 is locked in the preferred position by roller 17 fitting within one of the seats or indentations 43 on cam 23. The preferred embodiment has one or more indentations 43 within the cam 23 that allows the roller 17 to seat. This movement of the pressure plate 10 by operation of lever 20 acts as the micro adjustment.

A safety cover 44 has a top plate portion 45 and front depending flange 46. The top plate 45 is attached to a top edge 47 of pressure plate 10. Slots 48,49 in the top plate portion 45 and front depending flange 46 permit movement of the shaft 22 of lever 20 to be unimpeded by safety cover 44. The safety cover 44 protects the internal mechanisms of locking means 9 from dirt while also protecting the operator from the internal moving parts.

When grinding smaller bits, a bottom plate 50 can be attached to the bottom of bit holder fixture 2 below aperture 8. Bottom plate 50 has tabs 51,52 on the rear end of bottom plate 50 that fit in slots 53,54 in the V-shaped rear side 7 of bit holder fixture 2. A knob 55 holds the front end of bottom plate 50 against the block 38 by threading into hole 56. When small bits are being ground a multi-bit adapter 57 can be utilized. The multi-bit adapter illustrated permits up to three bits to be secured in the bit holder fixture at one time. If grinding down-the-hole bits with a long shank the bottom plate 50 can be removed.

The manual locking means of the present invention minimizes operator time when grinding multiple bits of the same size as the macro adjustment needs to be done only once then the micro adjustment is used to lock or release the bits from the bit holder fixture.

In FIG. 1, the grinding apparatus 1 shown is of the type intended to be mounted on drill rigs, service vehicles or set up in the shop, optionally installed inside a cabinet enclosure.

The grinding apparatus 1 includes a grinding machine 10 and a bit holder fixture 2 for holding one or more bits to be ground. In this embodiment the grinding machine 10 is carried by an arm or lever system, generally indicated at 58, attached to the frame 59 of the grinding apparatus. The arm or lever system 58 has a macro adjustment lever 60 that permits the grinding machine to be moved vertically. A compressed air connection is provided to operate various aspects of the grinding apparatus as discussed in detail below.

The grinding machine 10, in order to properly regrind a worn button, should be aligned with the longitudinal axis of the button. Accordingly to regrind the gauge buttons, bit holder fixture 2 is tilted to correspond to the angle at which the buttons are mounted in the bit. The bit is then indexed in the table so that the longitudinal axis of the button to be ground is in the vertical. The bit holder fixture 2 is attached to a pair of arms 61,62 journaled to the frame 59 of the grinding apparatus 1 on post 63. When the arm is folded as shown in FIG. 1 the bit holder fixture can be stowed securely against the frame of the grinder using a combination of latches 27A, 273 as shown in FIG. 2. This ensures that the bit holder fixture will not be damaged in transport when installed in mobile applications such as that of a drilling rig.

In order to further minimize operator set up and movement of the bit during regrinding, the side wall 4 of bit holder fixture 2 is tiltably mounted to the grinding apparatus 1 at pivot point 64 on an arm 62. The tilt control lever 65 controls the pivoting of bit holder fixture 2 along arcuate slot 66 in the side wall 4 of the bit holder fixture. A scale 67 is preferably provided to indicate the angle at which the bit holder fixture 2 will be tilted. Once set for a particular bit type, the angle is fixed and doesn't have to be reset for each bit or button to be reground.

A cylinder (not shown) on the arms controls the vertical movement of the grinding machine 10 up and down. The cylinder provides a balance pressure to the arm system when the grinding machine 10 is not in use and grinding pressure/feed when in use. The grinding balance pressure and pressure/feed can be adjusted.

The grinding apparatus 1 has a control box 68, containing a rotation motor and bearing arrangement for providing an orbital rotation to grinding machine 10. The grinding machine 10 is attached to control box 68 by means of plates 69. The grinding machine 10 has a hydraulic motor in the embodiment shown but can also utilize other motor types such as air or electric motors.

The present invention may be used with grinding apparatus that utilize relatively high feed forces applied during grinding, optionally combined with varying or relatively low spindle rpm's to optimize grinding of the buttons with reduced vibration, noise and grinding time. High feed forces in self-centering grinding machines could potentially cause the grinding machine 10 to fall off the button with great force. To produce the high feeds safely, a means by which to limit the travel of the feed is required. The need to limit travel may not be limited to feed but in any direction deemed necessary. In the embodiment shown, a brake is activated prior to grinding to lock the macro position of the arm system. A short stroke feed cylinder provides the feed pressure during grinding. The maximum stroke is about 50 mm in this embodiment. When this type of combination is activated, the travel of the grinding machine 10 in the direction of feed is limited to the relatively short stroke of the feed cylinder once the grinding cycle is activated. In the event that the grinding machine 10 falls off the button during a grinding cycle, the chances of any danger to the operator or damage to the grinding machine 10 etc. is minimized. To further minimize any damage to the equipment, grinding cups, bits, and to further minimize any chance of injury to operator, sensors in the above described cylinder combination would detect for example the feed cylinder reaching max stroke and immediately shut the grinding process down automatically. Similar safely systems can be incorporated into any method of achieving controlled feed.

Other potential solutions to achieve the same objective could be used including linear actuators or motorized screw or gear assemblies or any combination thereof potentially also including cylinder(s) optionally with break(s) to provide controlled movement and/or positioning and/or safety coupled with suitable load sensors and means to adjust the loads as deemed necessary.

Operator input panel 70 on control box 68 can also be used to set for example button size, grinding time, type of buttons, button wear, and feed pressure. Buttons are used to scroll through a menu and dial knob used to select values. The control system may be programmed with preset default values. Start button and stop button are provided an panel 70. Stop button 70 can optionally be used to reach one or more sub-menus.

The grinding machine 2 illustrated in the FIGURES utilizes a hex drive system of the type described in U.S. Pat. No. 5,639,273 and U.S. Pat. No. 5,727,994. In order to make the operation of the apparatus operator friendly, means are provided to easily align and attach the grinding cup and detach the grinding cup after use.

A programmable control card is provided within the control box 68 optionally attached to rear of operator input panel 70, having a circuit board containing the central processor (ie. microprocessor or microcontroller) for the control system of the grinding apparatus. The overall control system includes systems and controls that together with a microprocessor or microcontroller can control all aspects of the grinding apparatus including grinding time on each button, rotational speed of the grinding cup and grinding pressure. The microprocessor or microcontroller and the control system can be used to provide other functions either manual or automatic.

While typical grinding apparatus are aligned so that the longitudinal axis of the bit is generally vertical during grinding, in the case of very large bits, or in drilling equipment where bits or cutters are mounted in a clustered pattern, grinding may be done with the bit aligned horizontally or some other suitable angle. The present invention is equally applicable to this situation. In this situation the grinding machine may be carried on an arm or lever system and the grinding pressure applied in a horizontal or other suitable direction.

Relatively high feed forces in the grinding apparatus illustrated of between preferably 0 to 350 kilos and preferably up to about 115 KG, requires more power and torque from the grinding head motor than in known grinding apparatus. The present invention preferably utilizes a motor capable of producing substantially higher amounts of torque and/or power than previously used, over a range of rpm's, with a relatively compact size and weight. To further optimize the power and/or torque to size ratio, and to add the flexibility to change the motor performance characteristics as deemed appropriate the present invention preferably utilizes a hall sensor to monitor RPM of the grinding head.

At higher feed or grinding pressure, lower grinding cup rpm's (preferably 2200 to 9000 RPM vs 13,500 to 22,000 RPM in conventional grinders) has been shown to produce a much more stable and productive environment in which the abrasive (diamond matrix) on the grinding surface of the grinding cup can operate. The result is improved cutting performance, substantially improved cutting point regeneration, and improved grinding cup profile retention. In other words the abrasive is able to perform at its peak performance. In addition, the present invention has determined that variable RPM may be necessary to optimize grinding performance and economy for any given feed and/or carbide button size. Smaller buttons appear to require less feed than larger ones. Smaller buttons may also require somewhat higher RPM than larger ones. Either one or a combination of both variable RPM and feed may also be necessary during grinding of any one button for the purpose of initial heavy material removal rates followed by final surface finishing.

Certain known grinding apparatus, that use a gearbox principle tying orbital rotation of the grinding machine to spindle or grinding cup RPM, do not allow separate controls of orbital rotation speed and grinding head speed. Excessive orbital rotation speed has been shown to be a substantial source of instability during the grinding process. While the RPMs of devices using the gearbox principle can be increased or decreased by using a frequency inverter for example to control the output speed of the drive motor, the relatively high orbital rotation speed would result in a harsh and unstable process. The gear ratio used in known grinding machines of other manufacturers is approximately 1:3 (ie. 1 orbital rotation results in 3 output spindle rotation). The present invention optimizes stability and overall optimization of system performance by not tying orbital rotation of the grinding machine to spindle or grinding cup RPM.

To control all of the above functions an overall control system having an operator input panel directly connected to an electronic programmable control card module capable of issuing the necessary commands to for example an I/O card module etc. is preferably used. The control system utilizes a circuit board (programmable control card module) behind the operator input panel 70 on the control box 68 for input and processing of operator input. The programmable control card module and its circuit board is in communication with the I/O card module which connects to all main systems. Such a control system can be used to continuously monitor all or select operational parameters, and if deemed necessary, for example continuously adjust the feed pressure if the grinding head RPM rises above a set maximum or falls below a set minimum, increase coolant flow if motor temp gets too high, etc. Another example, when using a hydraulic or pneumatic motor on the grinding machine 10, variable speed is achieved by controlling either volume (flow) or pressure of from the pneumatic or hydraulic power source whichever is applicable. When using an electric motor on the grinding machine 10, variable speed is controlled by use of a frequency inverter. Utilizing software, microprocessor or microcontroller controlled grinding can influence the grinder behaviour characteristics. The software can in addition to providing operational parameters also deal with error reporting, service reminders, forced replacement of worn parts, components, or modules as deemed necessary for proper operation or to control access for maximized performance. It can also be used to substantially modify grinder behaviour by a simple re-programming or replacement of the microchip, microcontroller or processor. It could be made possible for the operator to update the programming or replacement of chip (and thus the grinders behaviour) right on site which ensures maximum grinder availability to the user. This would allow flexibility in terms of future grinder upgrades. For example, a new grinding cup with a new matrix formulation may require the grinder to behave differently. By simply changing the software program used by the grinder, the behaviour characteristics and any other key variables can be adjusted as required. This would ensure that user would receive customized/optimized performance from the grinder.

In addition, the control panel software can be configured such that the user could select for example whether long grinding cup life or high material removal rate of the grinding cup is preferred.

The present invention also preferably utilizes a "soft start" where grinding/feed pressure and grinding cup RPM are increased progressively either continuously or in steps to enhance the self-centering feature to whatever level deemed necessary. A benefit of a softer enhanced "self-centering" principle, as described above, is that it results in less dramatic wear and loads on built-in grinding cup profile resulting in enhanced grinding cup characteristics throughout its life.

Once the grinder is properly connected to the applicable power source and water source, the grinding apparatus is ready to grind. An initial operating sequence for a new set of bits, starting off by grinding the face buttons, with bit holder in down (horizontal) position could for example be as follows: a) load bit(s) into bit holder and secure using the manual locking means in bit holder or appropriate bit holder accessories b) determine size and profile of buttons on bit(s) to be ground c) Input estimated grinding time into primary menu on the operator control panel d) Scroll to next menu on the operator input panel and select button size and optionally profile e) Scroll to additional menus if necessary to input any other relevant data f) Place the grinder with grinding cup on top of button to be sharpened g) Press start and monitor the grinder to ensure proper function.

Grinding gauge buttons would be performed in the same manner as above after the following steps: a) angle of the gauge buttons is set by tilting the bit holder fixture 2.

Figure 9:
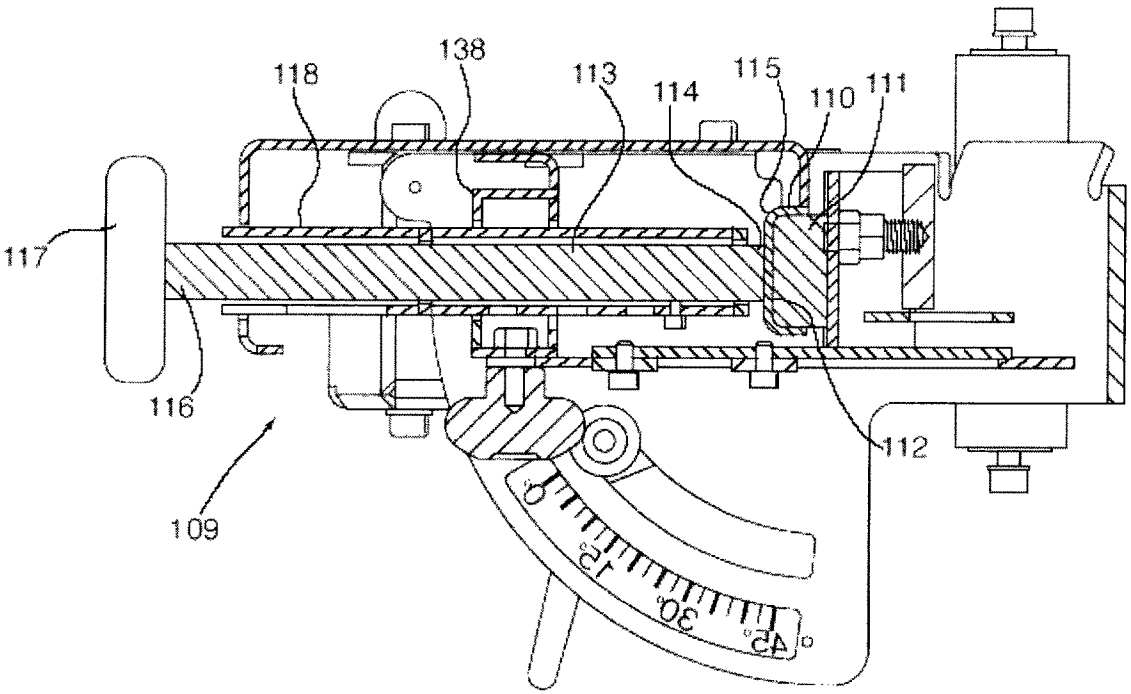
FIG. 9 is a side plan view in cross-section of another embodiment of a bit holder fixture with another embodiment of manual locking means according to the present invention with a macro adjustment means and a micro adjustment means.

In the embodiment illustrated in FIG. 9, the manual locking means 109 comprises an assembly including a pressure plate 110 having a generally rectangular configuration and with an pad 111 made preferably from an elastomeric material attached to a first face 112 of the pressure plate 110 intended to be facing bit(s) inserted into aperture 108 on bit holder fixture 102. This pad 111 helps hold the bit(s) securely as it conforms to the shape of the bit as pressure is applied. A threaded rod 113 has one end 114 rotatably attached perpendicular to a second face 115 of pressure plate 110. The other end 116 of the threaded rod 113 is adapted to retain a knob 117. The threaded rod 113 rotates within tube 118 having an internal threaded section that facilitates the threaded rod and so that the threaded rod 113 and tube 118 can move longitudinally relative to each other.

The locking means 109 assembly as described above is supported within a block 138 mounted on the front side 106 of bit holder fixture 102. The tube 118 slides within the opening 139 on block 138 with the pressure plate in aperture 108 on the bit holder fixture. A locking lever, similar to the one shown in FIGS. 1-8 is connected to a threaded rod which fits through a threaded hole in block 38. On the other end of threaded rod is a stopper. When locking lever is turned it tightens the stopper locking the tube 118 in position relative to the block 138. With locking lever loosened tube 118 slides easily through block 138 permitting pressure plate 110 to be moved into contact with the body of a bit (not shown) within aperture 108. Locking lever is then tightened to lock the second tube 118 in place. This acts as a macro adjustment of the locking means 109.

Once the macro adjustment is completed, the bit is then secured by turning threaded rod 113 using knob 117 to permit pressure plate 110 to be pushed towards the skirt or shank of the bit(s) within the aperture 108. The threaded rod 113 maintains the pressure applied onto pressure plate 110 until it is rotated so as to release the pressure. This movement of the pressure plate 110 by operation of the threaded rod acts as the micro adjustment.

Figure 10:
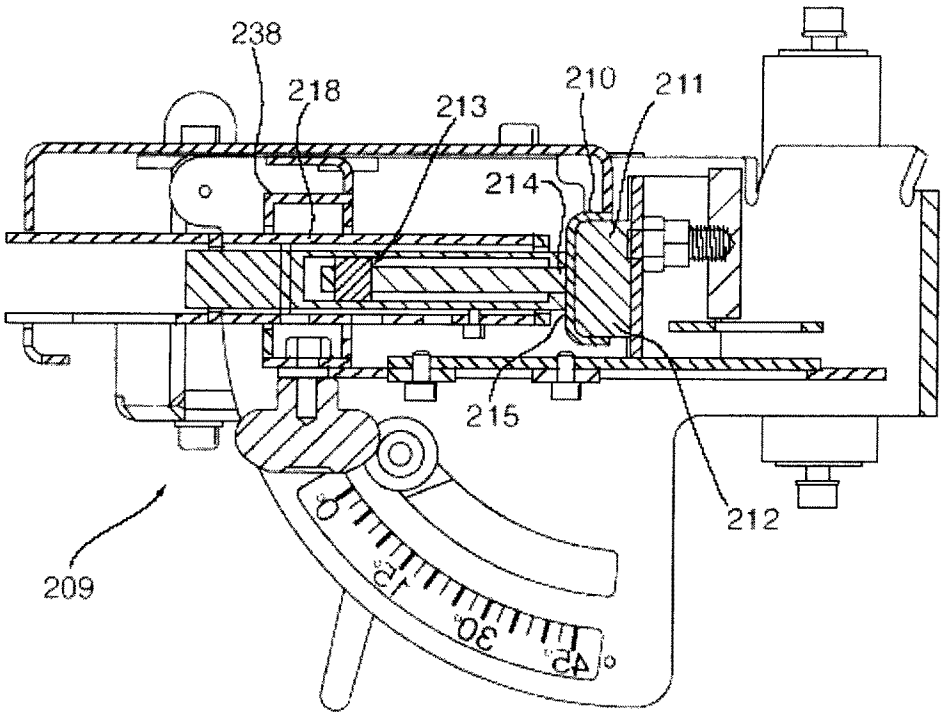
FIG. 10 is a side plan view in cross-section of another embodiment of a bit holder fixture with another embodiment of manual locking means according to the present invention with a macro adjustment means and a micro adjustment means.

In the embodiment illustrated in FIG. 10, the manual locking means 209 comprises an assembly including a pressure plate 210 having a generally rectangular configuration and with an pad 211 made preferably from an elastomeric material attached to a first face 212 of the pressure plate 210 intended to be facing bit(s) inserted into aperture 208 on bit holder fixture 202. This pad 211 helps hold the bit(s) securely as it conforms to the shape of the bit as pressure is applied. A piston rod of short stroke cylinder 213 has end 214 attached perpendicular to a second face 215 of pressure plate 210. The short stroke cylinder 213 is secured within tube 218 so that the piston rod of short stroke cylinder 213 and tube 218 move longitudinally relative to each other. Alternatively, the end of piston rod of short stroke cylinder 213 is attached to tube 218 and the opposite end of short stroke cylinder 213 is attached perpendicular to a second face 215 of pressure plate 210.

The locking means 209 assembly as described above is supported within a block 238 mounted on the front side 206 of bit holder fixture 202. Tube 218 slides within the opening 239 on block 238 with the pressure plate in aperture 208 on the bit holder fixture. A locking lever, similar to the one shown in FIGS. 1-8 is connected to a threaded rod which fits through a threaded hole in block 238. On the other end of threaded rod is a stopper. When locking lever is turned it tightens the stopper locking tube 118 in position relative to the block 238. With locking lever loosened tube 218 slides easily through block 238 permitting pressure plate 210 to be moved into contact with the body of a bit (not shown) within aperture 208. Locking lever is then tightened to lock the second tube 218 in place. This acts as a macro adjustment of the locking means 209.

Once the macro adjustment is completed, the bit is then secured by manually actuating a valve (not shown) that causes the piston rod of short stroke cylinder 213 to permit pressure plate 210 to be pushed towards the skirt or shank of the bit(s) within the aperture 208. The piston rod (assign number) of short stroke cylinder 213 maintains the pressure applied onto pressure plate 210 until the valve (not shown) is actuated so as to release the pressure. This movement of the pressure plate 210 by operation of the cylinder acts as the micro adjustment.

Figure 11:
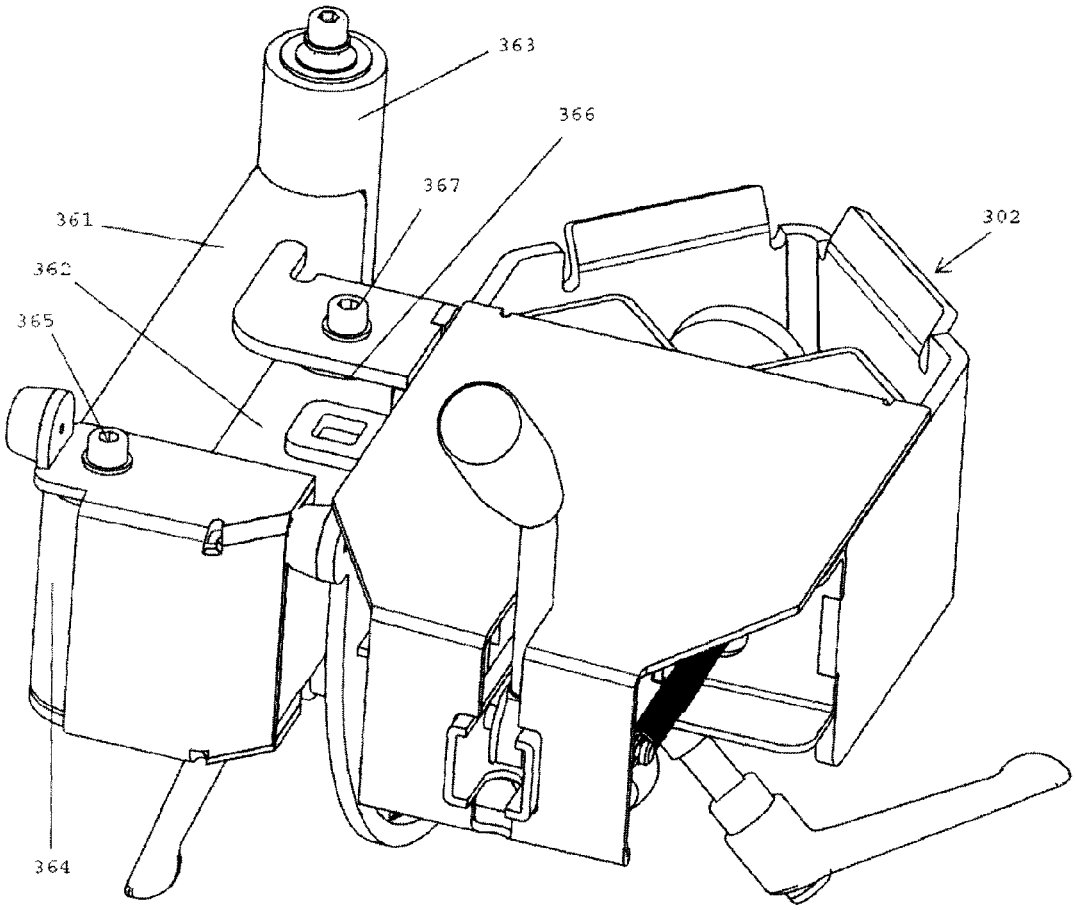
FIG. 11 is a perspective schematic view from the top front side of another embodiment of a bit holder fixture with manual locking means carried on an arm system with three points of articulation.

In FIG. 11, the bit holder fixture 302 of similar construction to the embodiment shown in FIGS. 1-8 is attached to a pair of arms 361,362. Arm 361 is journaled to the frame 359 of the grinding apparatus on post 363. The arm 362 is pivotally mounted to the end 364 of arm 361 remote from frame 359 and post 363 at pivot 365. The bit holder fixture 302 is pivotally connected to the other end 366 of arm 362 at pivot 367. This provides three articulations in the arms and bit holder fixture allowing better positioning of the bit holder fixture in both the stored and operative positions.

Having illustrated and described a preferred embodiment of the invention and certain possible modifications thereto, it should be apparent to those of ordinary skill in the art that the invention permits of further modification in arrangement and detail.

It will be appreciated that the above description related to the preferred embodiment by way of example only. Many variations on the invention will be obvious to those knowledgeable in the field, and such obvious variations are within the scope of the invention as described and claimed, whether or not expressly described.

The embodiments of the invention in which an exclusive property or privilege is claimed are defined as follows:

1. Locking means for a bit holder fixture for use with grinding apparatus for grinding hard metal inserts of rock drill bits, wherein the bit holding fixture has an end wall and the locking means comprise an assembly having a pressure plate with a first face facing the bit when the bit is inserted between the first face of the pressure plate and the end wall of the bit holder fixture, with macro adjustment means for positioning of the pressure plate against the body of the bit(s) with the body of the bit(s) in contact with the end wall and a micro adjustment means moveable relative to the macro adjustment means from a first position to a second locking position to lock the bit(s) in place by applying pressure against the pressure plate to retain the skirt or shank of the drill bit(s) in place against the end wall.

2. A locking means according to claim 1 wherein the macro adjustment means includes stop means for preventing movement of the pressure plate away from the body of the bit after positioning of the pressure plate against the body of the bit(s) with the body of the bit in contact with the end wall.

3. A locking means according to claim 2 wherein the assembly is supported within a guide mounted on the bit holder fixture.

4. A locking means according to claim 3 wherein the macro adjustment means includes an outer tube that is adapted to slide freely within the guide.

5. A locking means according to claim 4 wherein the stop means comprises a macro locking lever connected to the guide so that when the macro locking lever is tightened it locks the outer tube in position relative to the guide.

6. A locking means according to claim 5 wherein an inner tube having one end attached perpendicular to a second face of the pressure plate and another end of the inner tube is adapted to retain a roller; the inner tube slides within the outer tube; an end of the outer tube remote from the pressure plate is adapted to support a lever having a handle on one end of a shaft and a cam at the other end of the shaft and wherein the cam is spring biased to retain the cam in contact with the roller.

7. A locking means according to claim 6 wherein the outer tube slides within an opening in the guide with the pressure plate between the guide and the end wall on the bit holder fixture and the lever external to the guide.

8. A locking means according to claim 6 wherein rotating the cam causes the inner tube to slide longitudinally within the outer tube pushing the pressure plate towards the bit(s) within the aperture.

9. A locking means according to claim 8 wherein the cam is locked in the preferred position by the roller fitting within an indentation on the cam.

10. A locking means according to claim 9 wherein one or more indentations are provide on the cam that allows the roller to seat.

11. A locking means according to claim 7 wherein rotating the cam causes the inner tube to slide longitudinally within the outer tube pushing the pressure plate towards the bit(s) within the aperture.

12. A locking means according to claim 11 wherein the cam is locked in the preferred position by the roller fitting within an indentation on the cam.

13. A locking means according to claim 12 wherein one or more indentations are provide on the cam that allows the roller to seat.

14. A locking means according to claim 1 for grinding smaller bits, wherein a bottom plate can be attached to the bottom of the bit holder fixture.

15. A locking means according to claim 14 wherein the bottom plate has tabs on a rear end of the bottom plate that fit in slots in a rear side of the bit holder fixture.

16. A locking means according to claim 14 having a removable multi-bit adapter in the bit holder fixture.

17. A locking means according to claim 1 wherein a peripheral side wall of the bit holder fixture is tiltably mounted to the grinding apparatus.

18. A locking means according to claim 17 wherein the bit holding fixture has opposite peripheral side walls and an end wall connected to a first end of each of the opposite peripheral side walls and wherein the bit(s) is inserted into an aperture defined by the first face of the pressure plate, the opposite peripheral side walls and the end wall on the bit holder fixture.

19. A locking means according to claim 18 wherein the end wall is configured to retain the bit(s) when the pressure plate is positioned against the body of the bit(s) and with the body of the bit(s) is in contact with the end wall.

20. A locking means according to claim 1 wherein the bit holder fixture is attached to a pair of arms journaled to a frame of the grinding apparatus and having latch means so the bit holder fixture can be stowed securely against the frame of the grinder to protect the bit holder fixture from damage in transport when installed in mobile applications.

21. A locking means according to claim 1 wherein the grinding apparatus has means for providing a controlled variable feed pressure, a grinding machine equipped with a spindle assembly having an output drive shaft having a longitudinal axis, grinding tools of different sizes and profiles detachably connected to the output drive shaft for grinding different sizes and profiles of working tips and means for varying and controlling a speed of rotation of the output drive shaft and feed pressure based on a size of a connected grinding tool.

22. A locking means according to claim 21 wherein the grinding machine has a hydraulic motor.

23. A locking means according to claim 21 wherein the grinding machine has a pneumatic motor.

24. A locking means according to claim 21 wherein the grinding machine has an electric motor.

25. A locking means according to claim 21 wherein the grinding apparatus further has a control system that has a series of interconnected control modules having an operator input panel and a programmable control card module, the control system is adapted to monitor and to automatically adjust one or more operational parameters selected from a group consisting of the feed pressure and the rotational speed of the output drive shaft and a grinding time.

26. A locking means according to claim 25 wherein the series of interconnected control modules are connected to a multi-function input/output card module that acts as a central communications hub for all the interconnected control modules.

27. A locking means according to claim 26 wherein the interconnected control modules have one or more programmable microprocessors, microcontrollers or a combination thereof.

28. A locking means according to claim 27 wherein one or more programmable microprocessors, microcontrollers are replaceable to facilitate modification of a software integral to a functionality of the interconnected control modules.

29. A locking means according to claim 4 wherein a threaded rod has one end rotatably attached perpendicular to a second face of the pressure plate, the other end of the threaded rod is adapted to retain a knob, wherein the threaded rod rotates within the outer tube having an internal threaded section that facilitates the threaded rod and so that the threaded rod and tube can move longitudinally relative to each other.

30. A locking means according to claim 4 wherein a piston rod of a short stroke cylinder has one end attached perpendicular to a second face of the pressure plate, said short stroke cylinder is secured within the outer tube so that the piston rod of the short stroke cylinder and outer tube move longitudinally relative to each other.

31. A locking means according to claim 21 wherein the bit holder fixture is pivotally attached to one end of one of the pair of arms, the other end of one of the pair of arms is pivotally connected to a first end of the other one of the pair of arms which has a second end journalled to the frame, providing three articulations for the pair of arms and bit holder fixture.

* * * * *